US007848675B2

(12) United States Patent
Tsuchiya

(10) Patent No.: US 7,848,675 B2
(45) Date of Patent: Dec. 7, 2010

(54) IMAGE FORMING APPARATUS

(75) Inventor: Hiroaki Tsuchiya, Osaka (JP)

(73) Assignee: Kyocera Mita Corporation (JP)

( * ) Notice: Subject to any disclaimer, the term of this patent is extended or adjusted under 35 U.S.C. 154(b) by 290 days.

(21) Appl. No.: 12/031,805

(22) Filed: Feb. 15, 2008

(65) Prior Publication Data

US 2008/0226336 A1 Sep. 18, 2008

(30) Foreign Application Priority Data

Mar. 14, 2007 (JP) ..... 2007-065470

(51) Int. Cl.
*G03G 15/16* (2006.01)

(52) U.S. Cl. ..... 399/101

(58) Field of Classification Search ..... 399/101, 399/123, 297, 347, 348, 349; 15/364
See application file for complete search history.

(56) References Cited

U.S. PATENT DOCUMENTS 4,739,370 A * 4/1988 Yoshida et al. ..... 399/347
6,421,874 B1 * 7/2002 McCormick ..... 15/364
7,194,232 B2 * 3/2007 Kitagawa et al. ..... 399/297
7,480,471 B2 * 1/2009 Kitamura ..... 399/101
7,555,236 B2 * 6/2009 Saeki ..... 399/101

FOREIGN PATENT DOCUMENTS

JP 2003-316236 11/2003

* cited by examiner

*Primary Examiner*—David P Porta
*Assistant Examiner*—Faye Boosalis
(74) *Attorney, Agent, or Firm*—Gerald E. Hespos; Michael J. Porco

(57) ABSTRACT

An intermediate transferring unit (120) is provided with a main cleaning member (29*a*) together with an auxiliary cleaning member (50). A main cleaning width (Wb1) of the main cleaning member (29*a*) is smaller than a width dimension (Wb) of an intermediate transferring belt (12). The auxiliary cleaning member (50) covers an outer remaining area (M), so that toners remaining on the remaining area (M) are scraped off by the auxiliary cleaning member (50). The toners scraped off by the auxiliary cleaning member (50) are collected in a toner collecting portion provided in an apparatus main body.

14 Claims, 8 Drawing Sheets

IMAGE FORMING APPARATUS

BACKGROUND OF THE INVENTION

1. Field of the Invention

The present invention relates to an image forming apparatus in which an image is formed with use of a belt-like member.

2. Description of the Related Art

A conventional technology related to this kind of image forming apparatus has been known in which image forming is performed by primarily transferring a toner image to an intermediate transferring belt and then secondarily transferring the toner image to a sheet (for example, Japanese Patent Unexamined Publication No. 2003-316236). According to this conventional technology, an electrostatic latent image is formed on a surface of a photoconductive member in accordance with image data, and the latent image is developed for one color after another by a multi-color developing device, and the developed images are primarily transferred to an intermediate transferring belt. Then, toner images for respective colors are synthesized to be a single color toner image, and the color toner image is secondarily transferred from the intermediate transferring belt to a sheet.

Further, according to the conventional technology, a cleaning roller is provided in contact with the intermediate transferring belt, so that the cleaning roller cleans toners remaining on the intermediate transferring belt after the secondary transfer is performed.

The cleaning roller in the conventional technology normally extends in a width direction of the intermediate transferring belt, and it would be necessary that a cleaning width (a width along which the cleaning roller cleans a belt surface) of the cleaning roller covers an entire width of the intermediate transferring belt.

However, for example, when the arrangement of the cleaning roller in an image forming apparatus is limited, and a cleaning width is slightly smaller than an entire width of the intermediate transferring belt, toners cannot be removed by the cleaning roller if the toners are attached to or dispersed in portions out of the cleaning width. In this case, the toners remaining on the belt may undesirably mess up parts which are arranged in periphery of the cleaning roller.

It is considered that such problem can be solved by making the cleaning width be wider than the entire width of the intermediate transferring belt. However, it would be necessary to make a width of the cleaning roller itself be large, so that a problem that a width of a machine would also be large arises.

Therefore, an object of the present invention is to provide a technology of assuredly removing messes on the belt by using a simple mechanism without making respective widths of parts such as a cleaning roller to be large.

SUMMARY OF THE INVENTION

The present invention includes an image forming apparatus in which a toner image is transferred by a belt-like member. The belt-like member has an endless belt-like image forming surface running through a predetermined rotational path, and running of the belt-like member allows a toner image formed on the image forming surface to be transferred to another medium. The belt-like member may be a photoconductive belt which develops with toners an electrostatic latent image formed by charging and light exposure and transfers the developed image to a sheet or an intermediate transferring member. Alternatively, the belt-like member may be an intermediate transferring belt onto which a toner image is primarily transferred from a photoconductive member.

In cases where the belt member has any of the above-described configurations, the present invention is provided with first and second cleaning members for cleaning (removing messes such as remaining toners) the image forming surface of the belt-like member. The first cleaning member is adapted to clean the image forming surface along a first cleaning width which is smaller than an entire width of the image forming surface after a toner image is transferred from the belt-like member to another medium. Further, the second cleaning member is adapted to clean side end portions out of the first cleaning width of the image forming surface.

According to the configuration of the present invention, even when a first cleaning width (size of the first cleaning member) cannot be saved largely due to, for example, limitation of arrangement of the cleaning roller in the image forming apparatus, outer areas of the image forming surface can be cleaned by the second cleaning member. This allows messes on the belt-like member to be removed assuredly with a simple configuration, so that size of the first cleaning member in the apparatus main body can be made as small as possible. Further, size of the apparatus as a whole (especially the size in a width direction of the belt-like member) can be made small, so that it contributes to make an image forming apparatus be compact.

These and other objects, features and advantages of the present invention will become apparent upon reading of the following detailed description along with the accompanied drawings.

DETAILED DESCRIPTION OF THE PREFERRED EMBODIMENT

Hereinafter, a first embodiment of an image forming apparatus will be described.

Figure 1:
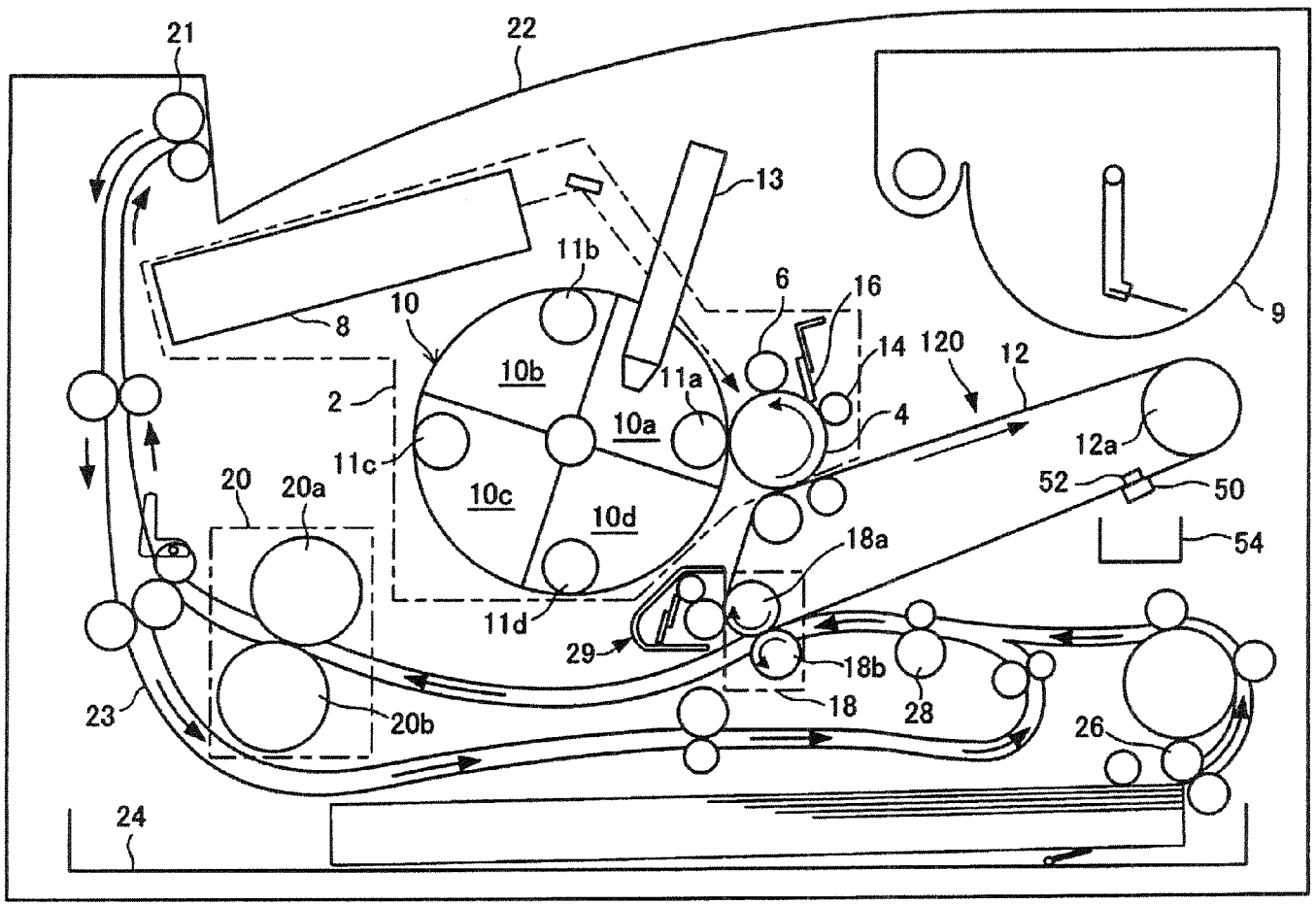
FIG. 1 is a schematic view showing a configuration example of an image forming apparatus of an embodiment.

FIG. 1 is a schematic view showing a configuration as a first embodiment of the image forming apparatus. In FIG. 1, the rightward direction corresponds to a front side of an image forming apparatus 1, and the leftward direction corresponds to a rear side. Thus, the leftward and rightward directions in FIG. 1 are corresponding to the frontward and rearward directions of the image forming apparatus 1. It should be understood that the schematic cross section shown in FIG. 1 corresponds to a vertical cross section of the image forming apparatus 1 viewed from a left side.

The image forming apparatus 1 includes an image forming section 2 in its main body. The image forming section 2 mainly has a photoconductive drum 4, a charging device 6, a laser scanning unit 8 and a developing unit 10.

The photoconductive drum 4 has a main body which includes a drum-like member of a rotation type, and a photoconductive member layer of, for example, an amorphous silicon is formed on an outer peripheral surface of the photoconductive drum 4. The photoconductive drum 4 is rotated in a counter-clockwise direction in FIG. 1, and this rotation causes the photoconductive drum 4 to perform on its outer peripheral surface a series of operations such as forming an electrostatic latent image, developing with use of toners, and a primary transfer of the toner image.

In a periphery of the photoconductive drum 4, the charging device 6 is provided close to an upper position of the photoconductive drum 4. The charging device 6 charges the outer peripheral surface of the photoconductive drum 4. In a state where the photoconductive drum 4 is charged, a scanning light as an image signal is irradiated from the laser scanning unit 8 toward the outer peripheral surface. At this time, a position to which the scanning light is irradiated is at downstream of the charging device 6 in a rotational direction of the photoconductive drum 4.

The laser scanning unit 8 reflects the laser light while rotating, for example, a polygon mirror at a high speed, and reflects on a flat mirror the laser light (scanning light) scanned in an axial direction of the photoconductive drum 4 to allow the outer peripheral surface of the photoconductive drum 4 to be exposed to the laser light. This allows an electrostatic latent image to be formed on the outer peripheral surface of the photoconductive drum 4.

The developing unit 10 is arranged closely to the outer peripheral surface of the photoconductive drum 4 on downstream of the irradiating position of the scanning light in the rotational direction of the photoconductive drum 4. The developing unit 10 develops an electrostatic latent image in a rotary method with use of toners of four colors (for example, magenta, cyan, yellow, black). Therefore, the developing unit 10 is also configured as to be rotatable and has four developing equipments 10*a*, 10*b*, 10*c*, 10*d* which are sectionalized for respective colors in a rotational direction. Each of the developing equipments 10*a* through 10*d* accommodates toners. Further, the developing equipments 10*a* through 10*d* have developing rollers 11*a* through 11*d*, respectively, each of which rotates while bearing toners on a respective outer peripheral surface.

Further, a toner container 9 is provided in the image forming apparatus 1, and toners for respective colors are supplied to the developing equipments 10*a* through 10*d* through a feed pipe 13. In the present embodiment, an unillustrated toner amount sensor detects toner amount of each of the developing equipments 10*a* through 10*d*, and toners are fed to retain a constant toner amount.

The developing unit 10 of a rotary type rotates and stops in such a manner that one of the developing equipments 10*a* through 10*d* which corresponds to a color to be developed faces the outer peripheral surface of the photoconductive drum 4. In a corresponding one of the developing equipments 10*a* through 10*d*, a respective one of the developing rollers 11*a* through 11*d* rotates while bearing a thin layer of toners on its outer peripheral surface, and a developing bias voltage including an AC-component and a DC-component is applied to one of the developing rollers 11*a* through 11*d*. This developing bias allows toners bore on the developing rollers 11*a* through 11*d* to be moved to an electrostatic latent image formed on the photoconductive drum 4 so that the electrostatic latent image is developed with toners of respective colors, and then a toner image as a visible image is formed on the outer peripheral surface of the photoconductive drum 4.

In the apparatus main body, there is provided an intermediate transferring unit 120 under the photoconductive drum 4 and the toner container 9. The intermediate transferring unit 120 is provided with an endless intermediate transferring belt 12 (belt-like member), and its surface (image forming surface) comes close to an outer peripheral surface of the photoconductive drum 4. The intermediate transferring belt 12 may be configured by, for example, a belt which is formed by superimposing and joining respective end portions of sheet members made of a dielectric resin, or a belt having no joints (seamless). The intermediate transferring belt 12 passes through a position in contact with the outer peripheral surface and runs in a rotational direction while being in synchronization with rotation of the photoconductive drum 4. The toner image formed on the photoconductive drum 4 is primarily transferred from the outer peripheral surface to the surface of the intermediate transferring belt 12 in accordance with rotation of the photoconductive drum 4.

In a periphery of the photoconductive drum 4, a slide-rubbing member 14 and a cleaning member 16 are arranged along the outer peripheral surface. The slide-rubbing member 14 and the cleaning member 16 are positioned on downstream of a position where the photoconductive drum 4 is in contact with the intermediate transferring belt 12 and on upstream of the charging device 6 in a rotational direction of the photoconductive drum 4. The slide-rubbing member 14 polishes the outer peripheral surface of the photoconductive drum 4 onto which the toner image is primarily transferred, so that an oxidized product attached to a layer of an amorphous silicon photoconductive member is removed. Further, the cleaning member 16 removes toners remaining on the outer peripheral surface of the photoconductive drum 4 and cleans the outer peripheral surface before next image forming is performed.

At a time of forming a full color image, electrostatic latent images for respective colors are formed on the photoconductive drum 4, and toner images developed by the developing unit 10 for respective colors are primarily transferred onto the intermediate transferring belt 12 in superimposition with each other, so that a color image for one page is synthesized.

The intermediate transferring belt 12 is wound around a driving roller 18*a* and a tension roller 12*a*, and a primary transfer position close to the photoconductive drum 4 is provided therebetween. The driving roller 18*a* is arranged on upstream of the primary transfer position in a rotational direction of the intermediate transferring belt 12, and the tension roller 12*a* is arranged on downstream. Further, the tension roller 12*a* applies an appropriate amount of tension to the intermediate transferring belt 12 with use of a repulsive force of, for example, an unillustrated spring.

At one end portion of the intermediate transferring belt 12, a transferring section 18 is provided. The transferring section 18 is provided with a transferring roller 18*b*. The transferring roller 18*b* is rotated in pair with the above-described driving roller 18*a* over the intermediate transferring belt 12. Therefore, in the transferring section 18, there is formed a transfer nip portion between the intermediate transferring belt 12 and the transferring roller 18*b*. A sheet passes through the transfer nip portion, so that a full-color toner image for one page is secondarily transferred from the intermediate transferring belt 12 to the sheet.

FIG. 1 shows arrows indicating a conveying direction of a sheet, and a fixing section 20 is provided on downstream of the transferring section 18 in the sheet conveying direction. The sheet onto which a toner image is secondarily transferred is heated and pressed in the fixing section when it passes through the nip portion between the heating roller 20*a* and the pressing roller 20*b*. This fixes the toner image onto the sheet. Thereafter, the sheet is conveyed in an upward direction at a rear end portion in the apparatus, and then discharged to the sheet-discharging tray 22 through the sheet-discharging roller 21.

In a case of forming images on both sides of a sheet, a part of the sheet which passes through the fixing section 20 once projects outward from the apparatus through the sheet-discharging roller 21. Thereafter, the sheet is taken into the apparatus again by a reverse rotation of the sheet-discharging roller 21, and then conveyed to the front surface side through a sheet reversing passage 23. Then, the sheet is conveyed to the transferring section 18 again, and a toner image corresponding to the other surface is secondarily transferred to the sheet. Thereafter, the toner image is fixed on the other surface of the sheet at the fixing section 20, and then discharged to the sheet-discharging tray 22.

The sheet onto which the toner image is transferred is accommodated in the sheet-supplying cassette 24 in a lower portion of the apparatus in a stacked state. The sheet is taken one after another from an upper most position of the stack and then conveyed to the transferring section 18 through the sheet-feeding roller 26 and the registration roller 28. The registration roller 28 once stops in a state of retaining the sheet, corrects inclination and skew of the sheet, and then sends out the sheet at a timing in synchronization with running of the intermediate transferring belt 12. This allows the toner image for one page to be accurately transferred to a prescribed position of the sheet.

There is provided a cleaning unit 29 near the transferring section 18 and adjacent to the intermediate transferring unit 120, and the cleaning unit 29 removes remaining toners attached to the intermediate transferring belt 12 after the toner image is transferred.

Further, in the present embodiment, auxiliary cleaning members 50 are provided in addition to the cleaning unit 29. The auxiliary cleaning members 50 are mounted to the intermediate transferring unit 120. The auxiliary cleaning member 50 comes in contact with the surface of the intermediate transferring belt 12 at positions other than the position of the cleaning unit 29. Further, back surface support members 52 are provided on a back surface (rear surface) of the intermediate transferring belt 12. The back surface support members 52 are so mounted as to nip the intermediate transferring belt 12 with the auxiliary cleaning members 50.

The auxiliary cleaning members 50 described above scrapes off toners remaining on the surface of the intermediate transferring belt 12 in accordance with running of the same and cooperate with the cleaning unit 29 to clean the surface of the intermediate transferring belt 12. Further, in the apparatus main body, a toner collecting portion 54 is provided under the intermediate transferring belt 12, so that toners scraped off by the auxiliary cleaning members 50 are collected in the toner collecting portion 54. The auxiliary cleaning members 50 and the back surface support members 52 will be described in detail hereinafter.

The basic configuration of the image forming apparatus 1 and its image forming operation are described above. In FIG. 1, an example of the image forming apparatus 1 which is configured as a color printer is shown. However, the image forming apparatus 1 of the present embodiment may be configured as a color copying machine and a color complex machine. In cases of those, the image forming apparatus 1 may have an image reading section in addition to the image forming section 2. The image reading section is provided with a scanning optical system in which, for example, a scanner lamp and a mirror are mounted, and an optical device such as a collective lens and a CCD are internally provided. Further, the image reading section may be so configured that a document automatic conveying mechanism (ADF) is mounted as an attachment.

Figure 2:
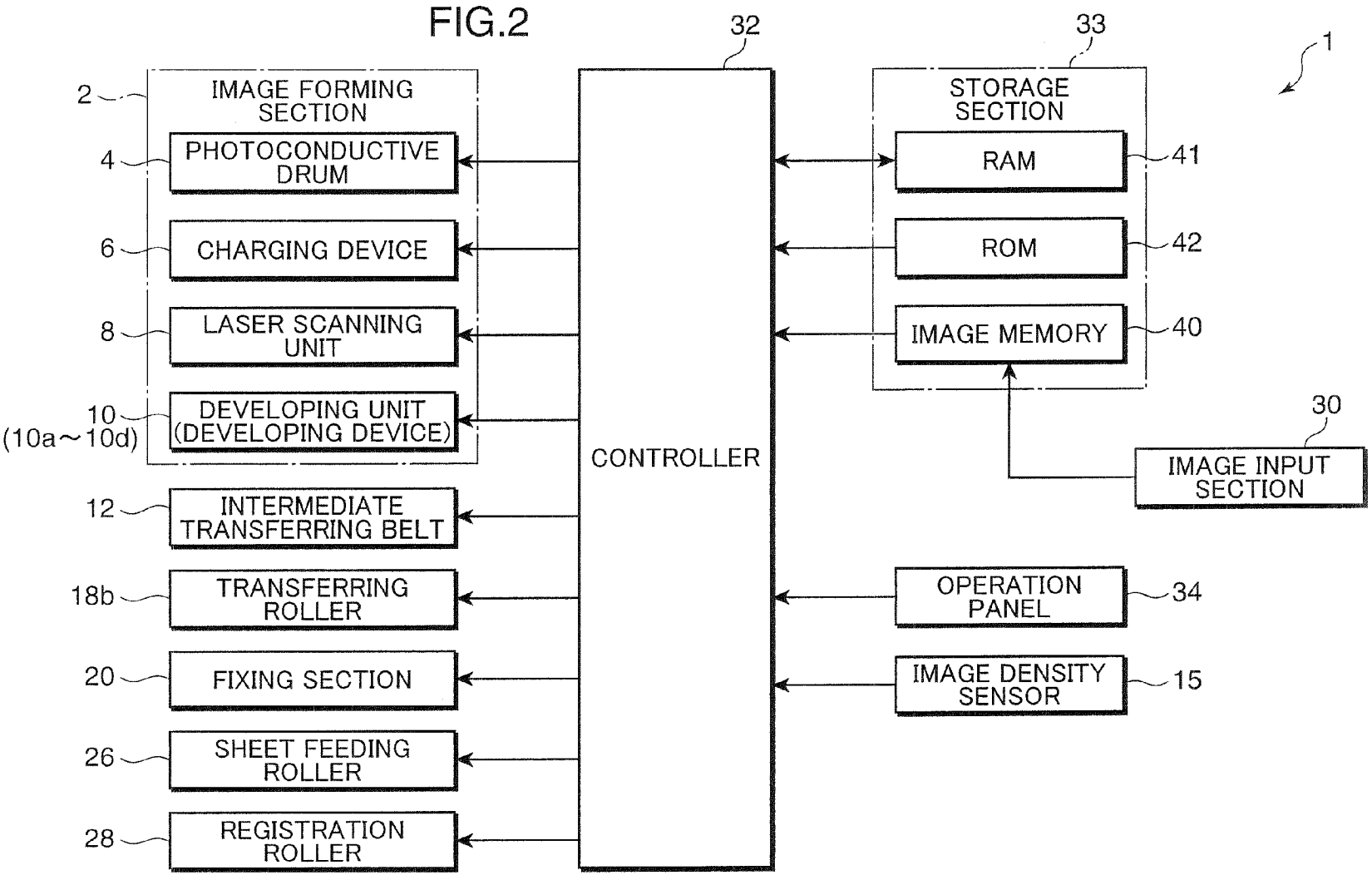
FIG. 2 is a block diagram showing a configuration related to a control of the image forming apparatus.

FIG. 2 is a block diagram showing a configuration related to a control of the image forming apparatus 1. As described above, the image forming apparatus 1 is provided with the image forming section 2, the intermediate transferring belt 12, the fixing section 20, the sheet feeding 26, and the registration roller 28. Further, the image forming apparatus 1 is provided with an image input section 30, a controller 32, a storage section 33, an operation panel 34, and the like as controlling elements.

The image input section 30 is configured as a receiving section for receiving image data (a group of image data for all pages) transmitted from, for example, an personal computer. In a case where the image forming apparatus 1 is a copying machine or a complex machine, the image input section 30 is configured by a scanning optical system which includes a scanner lamp for illuminating a document at a time of copying and a mirror for changing a light path of a light reflected from a document, a collective lens for collecting the reflected light from the document and forming an image, and a CCD for converting the formed image light to an electric signal. The image signal inputted to the image input section 30 is applied with a signal processing (P/S conversion, A/D conversion, or the like) when necessary, and thereafter transferred to an image memory 40 in the storage section 33.

The storage section 33 is provided with the image memory 40, a RAM 41, and a ROM 42. Among those, the image memory 40 is a buffer which is adapted to store an image signal transferred from the image input section 30 and transfer the same to the controller 32. The RAM 41 and the ROM 42 stores a processing program and a processing content of the control section, and further stores a set value and the like for a developing bias applied to the developing unit 10.

The operation panel 34 includes an operating section having a plurality of operation keys and a display portion for displaying settings and a status of the apparatus (any of those are not shown). It is favorable that a display portion be a liquid crystal display, and the display portion may be a touch panel which receives an operation through its display screen. Such operation panel 34 is provided on an exterior cover surface of the image forming apparatus 1 to receive settings such as a print setting inputted by a user through the operation keys. Further, for example, in a case where the image forming apparatus 1 has a facsimile function, the operation panel 34 may be used for registering facsimile addressees to the storage section 33, and further used for conducting various settings such reading and re-writing the registered addressees.

Driving sections including the photoconductive drum 4, the developing unit 10, the intermediate transferring belt 12, the transferring roller 18*b*, and the fixing section 20 are driven by a main motor which is not illustrated. The controller 32 has a function of controlling rotation of the main motor to allow the various driving portions to be operated appropriately. In a case of driving or stopping only any one of the driving portions, a clutch mechanism (not shown) provided between the main motor and a respective driving portion is connected or disconnected. It may be so configured that a motor for exclusive use is connected to each of the driving portions so that each unit is driven independently from other units.

Further, the controller 32 is connected with an image density sensor 15 (not shown in FIG. 1), and the image density sensor 15 inputs a density detection signal of a toner image formed on the intermediate transferring belt 12. The image density sensor 15 detects an image density of a patch formed at a time when a calibration is performed, and its is used when a density adjustment is performed.

Furthermore, the controller 32 is connected with a drive motor (not shown) for performing feeding of a sheet and conveying and discharging of a sheet onto which an image is transferred, and the controller 32 sends a control signal to the drive motor. The controller 32 controls a rotational state of the drive motor, so that respective rotations of the sheet-feeding roller 26, the registration roller 28, and the sheet-discharging roller 21 (not shown in FIG. 2) are controlled.

Furthermore, the controller 32 generally controls the image input section 30, the image forming section 2, and the fixing section 20 in accordance with a set program, and it converts an image signal inputted from the image input section 30 to image data and executes a magnification processing or a gradation processing when necessary. The converted image data includes four image signals for respective colors of magenta, cyan, yellow, and black to form a color image. The image signal for respective colors are transmitted in a certain order to a laser scanning unit 8 of the image forming section 2. The laser scanning unit 8 generates a pulse laser light in accordance with the image signal transmitted from the controller 32 and irradiates the pulse laser light to the outer peripheral surface of the photoconductive drum 4 while reflecting the same on a polygon mirror.

On the other hand, the image forming section 2 sends synchronizing signals individually (for respective colors) to the controller 32. The synchronizing signals are used for synchronizing timings that the controller 32 transmits image signals for respective colors. When developing of an image is performed by each of the developing equipments 10*a* through 10*d* in the developing unit 10, the synchronizing signals are sent sequentially from an image forming controller. Then, when the controller 32 receives synchronizing signals for respective colors, image signals for respective colors are transmitted to the image forming section in the order of reception.

(Details of a Cleaning Mechanism)

Next, in addition to the cleaning unit 29 described above, configurations of the auxiliary cleaning members 50 and the back surface support members 52 will be described in detail.

Figure 3:
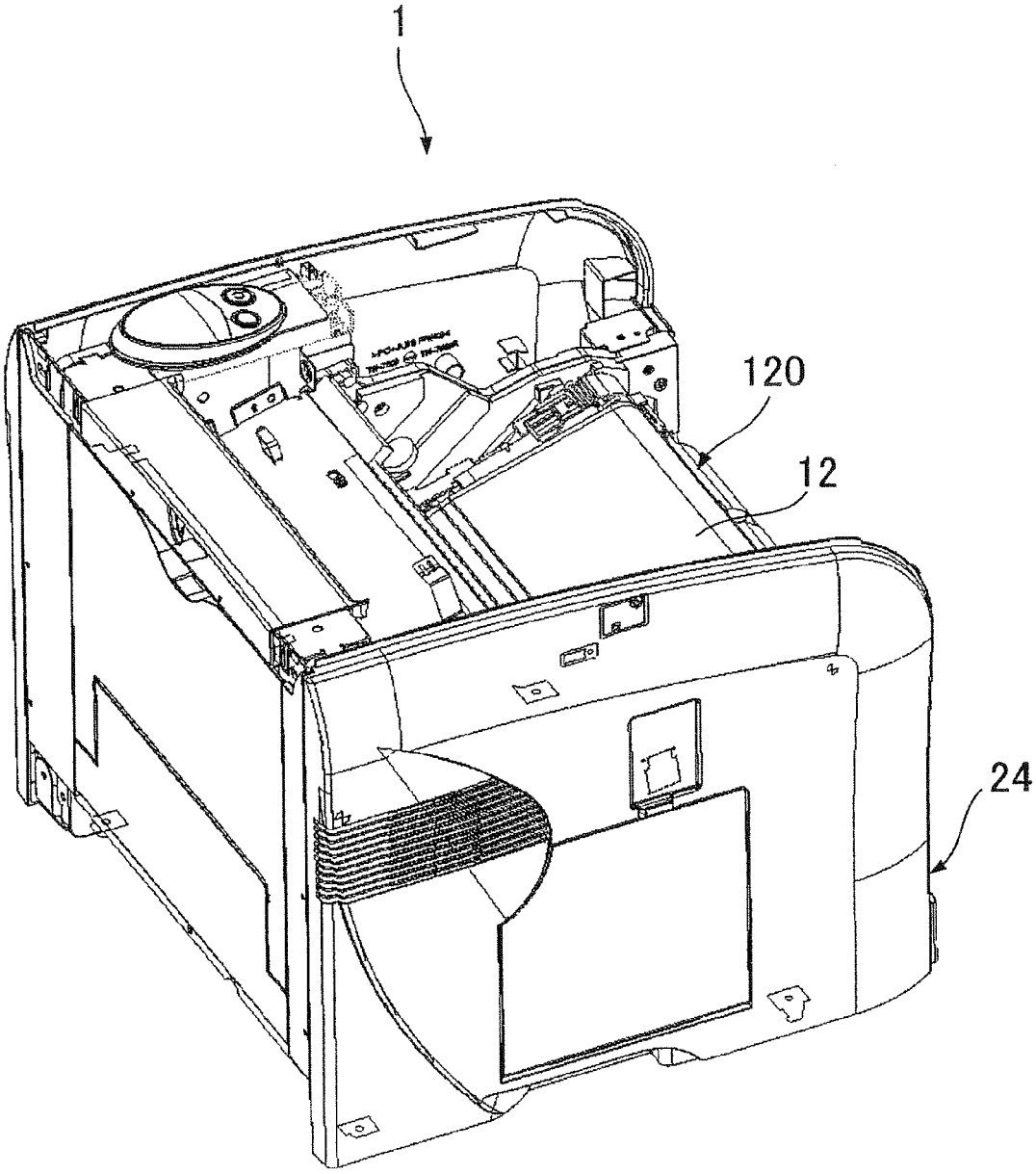
FIG. 3 is a perspective view showing a state where an intermediate transferring unit is mounted to an apparatus main body.
Figure 4:
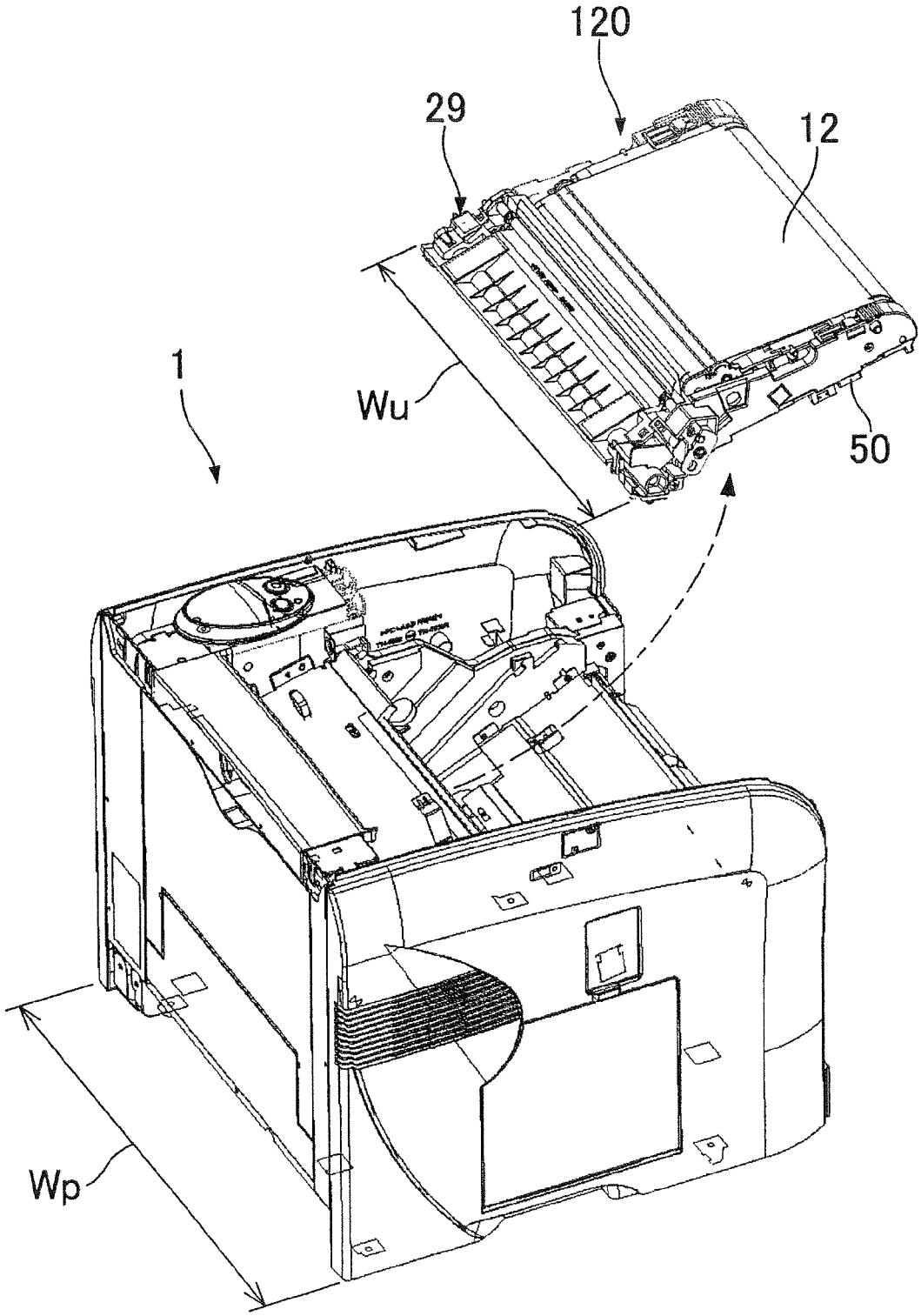
FIG. 4 is a perspective view showing a state where the intermediate transferring unit and a cleaning unit are detached from the apparatus main body.

FIGS. 3 and 4 respectively show states where the intermediate transferring belt 12 and the cleaning unit 29 are mounted to and detached from a main body of the image forming apparatus 1. FIG. 3 is a perspective view showing a state where the intermediate transferring unit 120 is mounted to the apparatus main body. FIG. 4 is a perspective view showing a state where the intermediate transferring unit 120 and the cleaning unit 29 are detached from the apparatus main body. In FIGS. 3 and 4, the oblique upper right side corresponds to the front side, the right side in FIG. 1, of the apparatus main body. Further, in FIGS. 3 and 4, an exterior cover provided on the upper surface apparatus main body is omitted from depiction.

Firstly, as shown in FIG. 3, when the exterior cover provided on the upper surface of the apparatus main body is opened, and the toner container 9 is detached, the intermediate transferring unit 120 is exposed to outside. When a user grabs a handle portion (not especially shown in the drawing) and pulls up the intermediate transferring unit 120 in a slightly oblique upward direction in this state, the intermediate transferring unit 120 and the cleaning unit 29 are detached from the apparatus main body. The units can be mounted by following the steps reversely.

In the present embodiment, respective width dimensions Wu of the intermediate transferring unit 120 and the cleaning unit 29 which are mounted in the apparatus main body are set to be as small as possible in view of a request to make a width dimension Wp of the apparatus main body as small as possible. In other words, making the width dimensions Wu of the intermediate transferring unit 120 and the cleaning unit 29 be as small as possible makes the width dimension Wp of the apparatus main body be small.

Figure 5A:
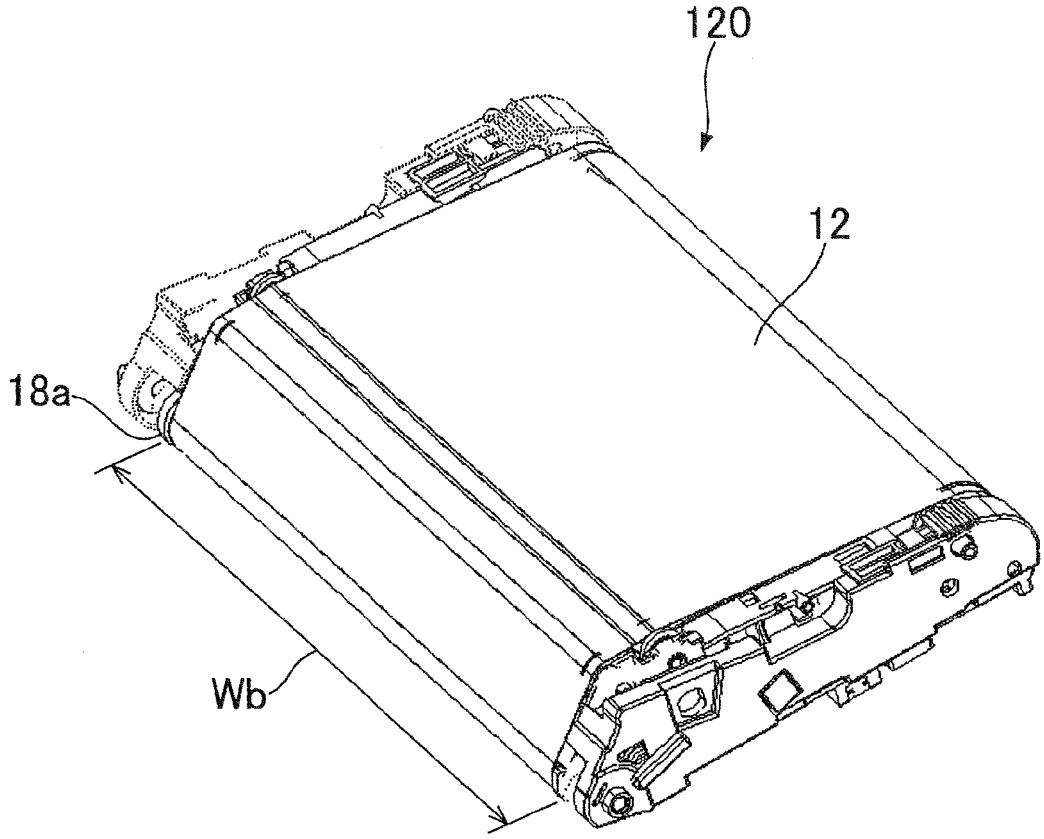
FIGS. 5A and 5B show perspective views of the intermediate transferring unit and the cleaning unit, respectively.
Figure 5B:
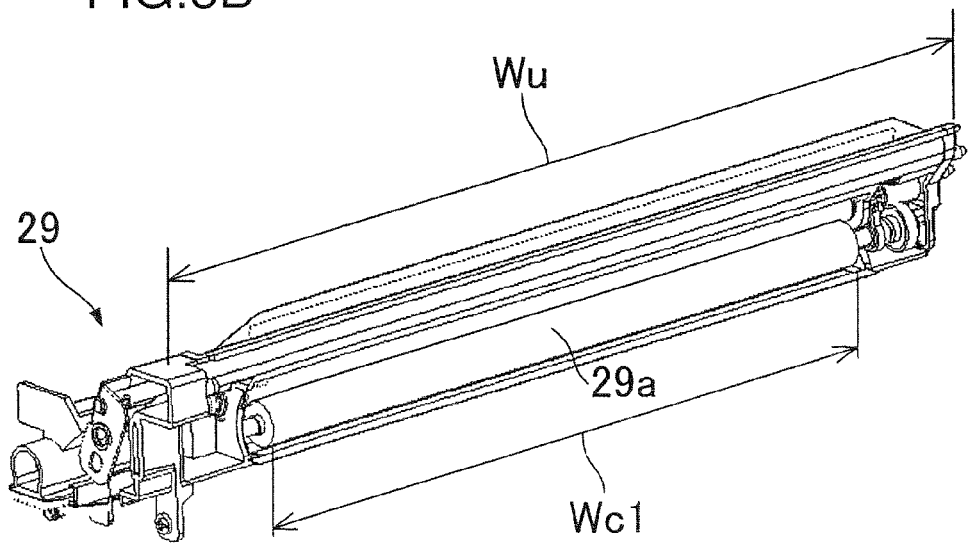

FIG. 5 shows respective perspective views of the intermediate transferring unit 120 and the cleaning unit 29. FIG. 5A shows the intermediate transferring unit 120 viewed from the oblique upper side, and FIG. 5B shows the cleaning unit 29 viewed from the oblique lower side.

As shown in 5A, the width dimension Wb of the intermediate transferring belt 12 is so set as to be have a size in conformity with sheet size and sheet direction adopted in the image forming apparatus 1. In other words, the width dimension Wb of the intermediate transferring belt 12 is set taking in consideration that a toner image is formed (transferred) within an area having a width slightly larger than a width of a sheet.

As shown in FIG. 5B, the cleaning unit 29 is provided with a roller-like main cleaning member (first cleaning member) 29*a* internally. The main cleaning member 29*a* rotates while being in contact with the intermediate transferring belt 12 at a position facing the driving roller 18*a* to remove remaining toners and the like after the secondary transfer is performed. At this time, the length dimension of the main cleaning member 29*a* corresponds to its main cleaning width Wc1. In other words, the main cleaning member 29*a* can clean the surface of the intermediate transferring belt 12 within a range of the main cleaning width Wc1.

Here, in present embodiment, since it would be necessary to make the width dimension Wu of the cleaning unit 29 be as small as possible, the length of the main cleaning member 29*a*, in other words, the main cleaning width Wc1 is so set as to be smaller than the width dimension Wb of the intermediate transferring belt 12. This is because the main cleaning member 29*a* should not be made unnecessarily long since driving parts (gear train, bearing, and the like) are accommodated in addition to the main cleaning member 29*a* within the whole width dimension Wp.

Figure 6:
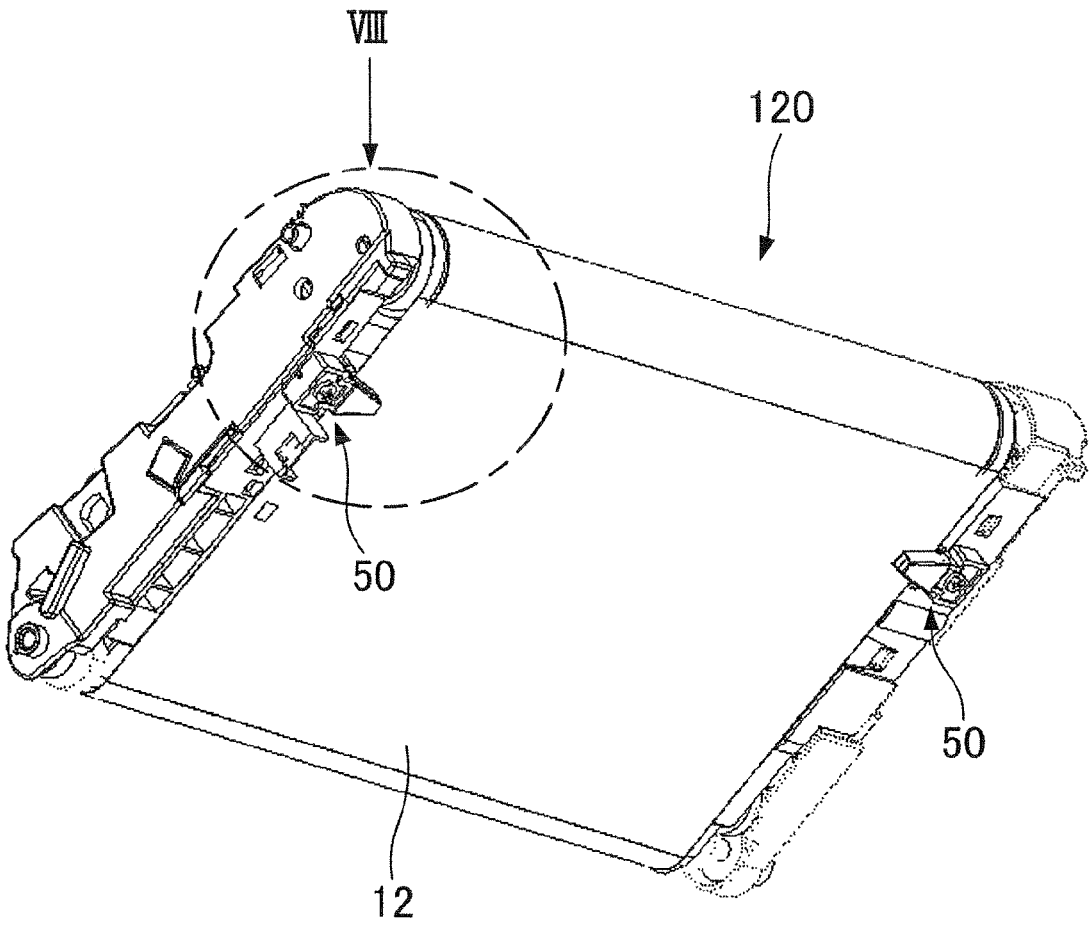
FIG. 6 is a perspective view showing the intermediate transferring unit viewed from the oblique lower side.

Next, FIG. 6 is a perspective view showing the intermediate transferring unit 120 viewed from the oblique lower side. On opposite sides of the intermediate transferring belt 12 of the intermediate transferring unit 120, two auxiliary cleaning members 50 are attached respectively. The auxiliary cleaning members 50 are so arranged as to face the opposite side ends of the intermediate transferring belt 12 at positions in a lower side of the intermediate transferring unit 120. The auxiliary cleaning members 50 clean the surface of the intermediate transferring belt 12, especially the opposite side ends, which are positions other than those cleaned by the main cleaning member 29*a*.

Figure 7A:
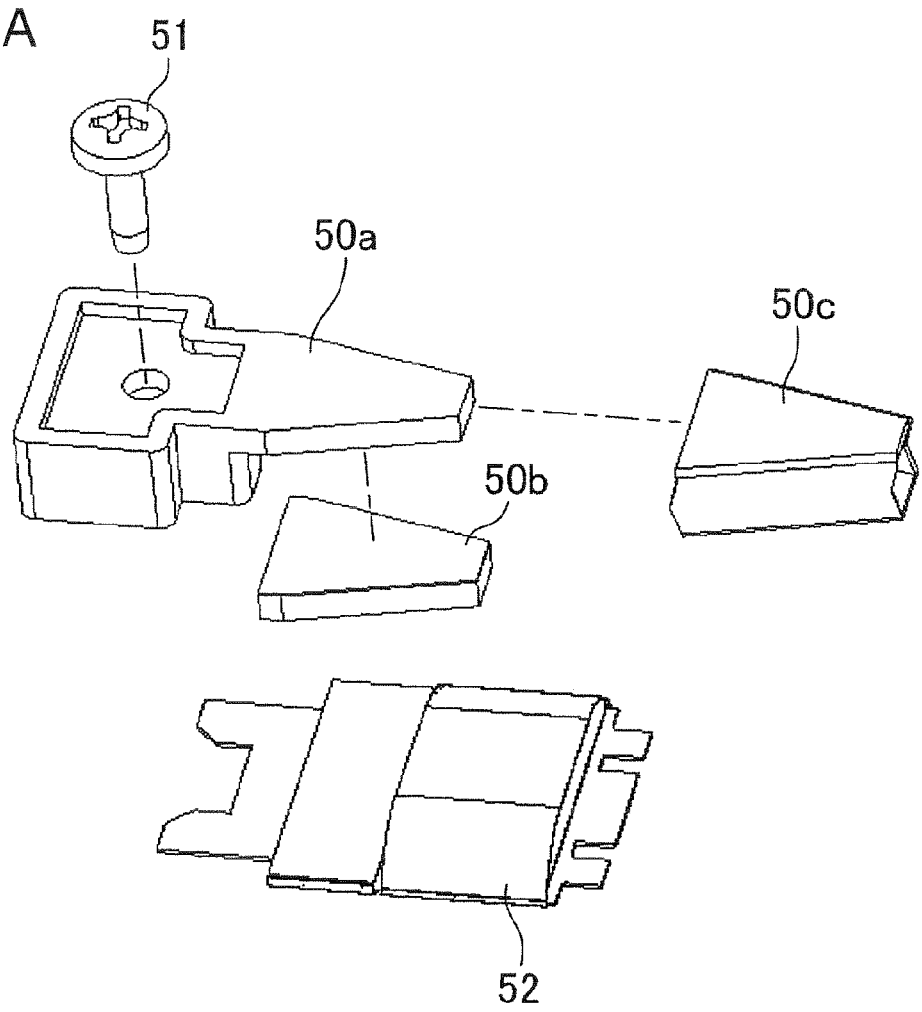
FIGS. 7A and 7B are detail views showing an auxiliary cleaning member and a back surface support member.
Figure 7B:
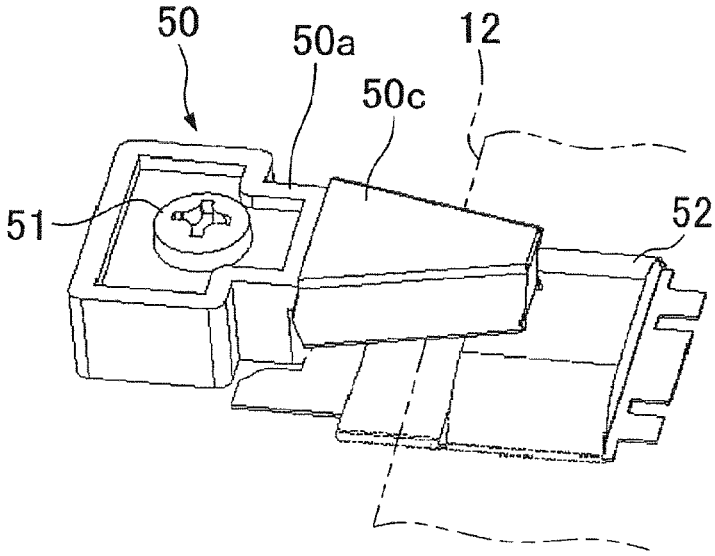

FIG. 7 shows detail views of the auxiliary cleaning member 50 and the back surface support member 52. In particular, FIG. 7A is an exploded view showing parts of the auxiliary cleaning member 50, and FIG. 7B shows an assembled state of those parts. The upper side of FIG. 7 corresponds to the lower side of the actual intermediate transferring unit 120. Accordingly, FIG. 7 shows a vertically inverted state of the auxiliary cleaning member 50.

As shown in FIG. 7A, the auxiliary cleaning member 50 includes a base member 50*a*, a cushion member 50*b*, and a felt-like member 50*c*. The base member 50*a* is a part made of, for example, resin. The base member 50*a* is fixed to the intermediate transferring unit 120 with a screw 5 1. Further, the base member 50*a* has a trapezoidal plate-like leading end portion horizontally extending from a portion to be screwed. In the leading end portion, the cushion member 50*b* is pasted on a surface facing the surface (the lower surface in the drawing) of the intermediate transferring belt 12. In this state, the felt-like member 50*c* is attached to the leading end portion of the base member 50*a* so as to cover the same. The felt-like member 50*c* has a cylindrical shape so formed as to be wound around an outer periphery of the leading end of the base member 50*a* and the cushion member 50*b*. The cushion member 50*b* is an elastic member made of elastic material such as a sponge, a rubber, or the like.

In the present embodiment, the felt-like member 50*c* may be a felted fabric or a pile fabric product (brush). A pile fabric is a known fabric which is widely used as a cleaning brush in this kind of image forming apparatus 1, and it can be obtained in a relatively easy manner for practicing the present invention. Normally, a pile fabric includes a ground fabric which is planarly (X-Y plane) woven with warp and woof and pile yarns standing (in a Z-axis direction) from the ground fabric.

A known cleaning brush normally includes pile yarns and filament yarns. Each filament yarn includes a bundle of a plurality of filaments. A yarn having such configuration is named "a multi-filament yarn". A single filament is a microfiber having a diameter of 0.1 mm. When such pile fabric is used, the felt-like member 50*c* can be shaped by winding the ground fabric to be a cylindrical shape as shown in FIG. 7B.

Further, the back surface support member 52 includes integrally formed parts made of, for example, resin. Such back surface support member 52 can support the intermediate transferring belt 12 from a back side (back surface) with a trapezoidal rising portion in the drawing.

As shown in FIG. 7B, in the state where the auxiliary cleaning member 50 and the back surface support member 52 are assembled, the intermediate transferring belt 12 runs while being nipped between the auxiliary cleaning member 50 and the back surface support member 52. At this time, the auxiliary cleaning member 50 makes the above-described felt-like member 50*c* come in contact with the intermediate transferring belt 12, and the back surface support member 52 presses the intermediate transferring belt 12 from the rear surface side. At this time, since the cushion member 50*b* is provided inside of the felt-like member 50, the felt-like member 50*c* does not strongly rub the surface of the intermediate transferring belt 12.

Figure 8:
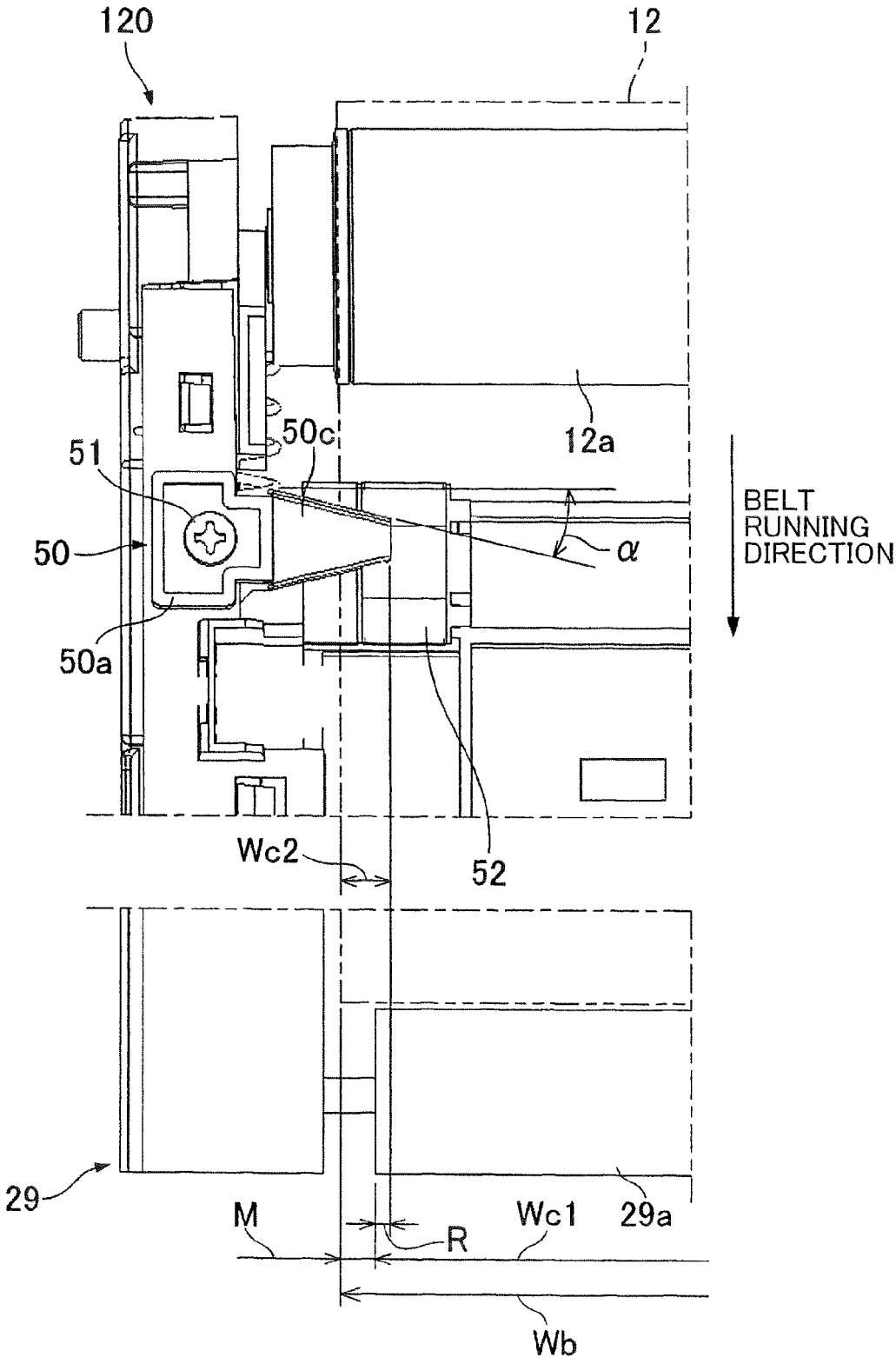
FIG. 8 is a bottom view enlarging vicinity of an attachment portion of the auxiliary cleaning member on one side.

FIG. 8 is a bottom view showing the intermediate transferring unit 120, where vicinity of an attachment portion of the auxiliary cleaning member 50 on one side is enlarged. The portion shown in FIG. 8 corresponds to a portion circled with an ellipse (arrow VIII) depicted with a one-dotted chain line in FIG. 6. FIG. 8 particularly shows a positional relationship between the main cleaning member 29*a* and the auxiliary cleaning member 50.

Firstly, as described above, the main cleaning width Wc1 of the main cleaning member 29*a* is so set as to be smaller than the width dimension Wb of the intermediate transferring belt 12. As shown in FIG. 8, the intermediate transferring belt 12 extends to opposite outer sides beyond the main cleaning width Wc1. Therefore, the main cleaning member 29*a* cannot clean the whole widthwise area of the intermediate transferring belt 12, so that a remaining area M occurs on the opposite side end portions.

The auxiliary cleaning members 50 extend from the opposite outer sides toward the center of the intermediate transferring belt 12 and make the above-described felt-like members 50*c* come in contact with the surface of the intermediate transferring belt 12. Therefore, the auxiliary cleaning member 50 has an auxiliary cleaning width Wc2 within this range, and the auxiliary cleaning width Wc2 is so set as to be larger than the remaining area M (Wc2>M).

Thus, when remaining toners which cannot be removed by the main cleaning member 29*a* exist on the surface of the intermediate transferring belt 12, the auxiliary cleaning member 50 arranged at other positions can scrape off all of the remaining toners. Further, as described above, the remaining toners which are scraped off are collected in the toner collecting portion 54 provided on the lower side (refer to FIG. 1).

Further, in the present embodiment, the auxiliary cleaning width Wc2 is so set as to be larger than the remaining area M by the dimension R. Therefore, the auxiliary cleaning width Wc2 and the main cleaning width Wc1 overlap with each other by the amount of dimension R in the width direction of the intermediate transferring belt 12. Accordingly, the remaining toners can be assuredly removed from a whole width area of the intermediate transferring belt 12.

Further, in the present embodiment, each of the auxiliary cleaning member 50 is tapered toward its leading end. Therefore, an edge (border line) of the contact surface between the intermediate transferring belt 12 and the felt-like member 50*c* becomes oblique (angle "α" in the drawing) with respect to the width direction of the intermediate transferring belt 12. The edge becomes oblique toward downstream in the running direction of the intermediate transferring belt 12.

In this case, when the remaining toners on the opposite side end portions of the intermediate transferring belt 12 are scraped off by the auxiliary cleaning members 50, the toners are collected toward the center along the obliqueness of the edges. The remaining toners collected toward the center are cleaned by the main cleaning member at a downstream position, so that they do not enter the toner image area.

As described above, in the present embodiment, the main cleaning member 29*a* and the auxiliary cleaning members 50 cooperate with each other to assuredly clean the surface of the intermediate transferring belt 12. Therefore, since it would not be necessary to cover a whole width area of the intermediate transferring belt 12 with only one main cleaning member 29*a*, the width dimension of the main cleaning member 29*a* can be made small, and the width dimension Wu of the cleaning unit 29 and the intermediate transferring unit 120 can be made as small as possible, so that it contributes to reduction of the width dimension Wp of the apparatus main body.

The present invention is not limited to the above-described embodiment, and it may be modified in various ways for practice. For example, the auxiliary cleaning member 50 is not limited to be provided on opposite sides of the intermediate transferring belt 12, and it may be provided only on one side. In this case, a whole width area of the intermediate transferring belt 12 can be covered by moving the position of the main cleaning member 29*a* in an axial direction (longitudinal direction) toward the side opposite from the auxiliary cleaning member 50.

Further, in the embodiment, the auxiliary cleaning members 50 are arranged on the lower side of the intermediate transferring unit 120. However, the auxiliary cleaning members 50 may be provided on the side surfaces (on the side portions of the tension roller 12*a*). Alternatively, the auxiliary cleaning members 50 may be arranged on a plurality of parts of the intermediate transferring belt 12 in a circumferential direction, or may be arranged staggeredly.

Other than the above, the shapes and sizes of the main cleaning member 29*a* and the auxiliary cleaning members 50 are favorable examples, and those may be modified as needed for practicing the invention.

In the embodiment, the example of cleaning the remaining toners on the intermediate transferring belt 12 is described. However, the present invention may be applied to the case of cleaning a belt-like photoconductive member.

In the first embodiment, the developing unit 10 of a rotary type is shown as an example. However, a developing unit may be of a tandem type. Further, an image forming apparatus of a full-color type is shown in the first embodiment. However, the image forming apparatus may be of a monochromatic type.

In summary, the present invention includes an image forming apparatus in which a toner image is transferred by a belt-like member. The belt-like member has an endless belt-like image forming surface running through a predetermined rotational path, and running of the belt-like member allows a toner image formed on the image forming surface to be transferred to another medium. The belt-like member may be a photoconductive belt which develops with toners an electrostatic latent image formed by charging and light exposure and transfers the developed image to a sheet or an intermediate transferring member. Alternatively, the belt-like member may be an intermediate transferring belt onto which a toner image is primarily transferred from a photoconductive member.

In cases where the belt member has any of the above-described configurations, the present invention is provided with first and second cleaning members for cleaning (removing messes such as remaining toners) the image forming surface of the belt-like member. The first cleaning member is adapted to clean the image forming surface along a first cleaning width which is smaller than an entire width of the image forming surface after a toner image is transferred from the belt-like member to another medium. Further, the second cleaning member is adapted to clean side end portions out of the first cleaning width of the image forming surface.

According to the configuration of the present invention, even when a first cleaning width (size of the first cleaning member) cannot be saved largely due to, for example, limitation of arrangement of the cleaning roller in the image forming apparatus, outer areas of the image forming surface can be cleaned by the second cleaning member. This allows messes on the belt-like member to be removed assuredly with a simple configuration, so that size of the first cleaning member in the apparatus main body can be made as small as possible. Further, size of the apparatus as a whole (especially the size in a width direction of the belt-like member) can be made small, so that it contributes to make an image forming apparatus be compact.

The first cleaning member may be a main cleaning member for cleaning an area including a central portion of an entire width of the image forming surface, and the second cleaning member may be an auxiliary cleaning member arranged on an outer side of the main cleaning member (first cleaning member) in a width direction of the belt-like member.

Further, it is preferable that the first cleaning member and second cleaning member are provided at positions different from one another in a rotational direction of a rotational path of the belt-like member. In this case, it would not be necessary to arrange the first cleaning member and the second cleaning member in the width direction at the same position on the rotational path, so that a width dimension as a whole can be made small in an easy manner. Further, flexibility in arrangement of the first and second cleaning members becomes higher, so that it becomes advantageous the arrangement would not be interfered by a layout inside the image forming apparatus.

Further, it is preferable that the first cleaning width and the second cleaning width are overlapping with each other in a width direction of the belt-like member. This eliminates left-over area (area out of the cleaning width) between the first cleaning member and the second cleaning member, so that the image forming surface of the belt-like member can be cleaned assuredly throughout a whole width.

Further, it is preferable that the area where the second cleaning member cleans the image forming surface includes a border line which is oblique with respect to the width direction of the belt-like member. In this case, toners scraped off by the second cleaning member move in an oblique direction along with running of the belt-like member, so that the toners become unlikely to remain at the position of the border line.

More preferably, the border line is oblique toward downstream in the running direction of the belt-like member. This makes toners which are scraped off by the second cleaning member come toward the central portion along with running of the belt-like member. The toners which come to the central portion are removed assuredly by the first cleaning member.

The second cleaning member may be arranged at a side position or a lower position of the belt-like member on the rotational path. In this case, it is preferable that the image forming apparatus according to the present invention is further provided with a collecting portion. The collecting portion is provided at a further lower position of the second cleaning member so as to collect at this position the remaining toners scraped off by the second cleaning member.

Further, the second cleaning member includes: a felt-like member which comes in contact with the image forming surface of the belt-like member; a base member for supporting the felt-like member; and an elastic member provided between the base member and the felt-like member to urge the felt-like member toward the image forming surface.

In this case, the felt-like member does not rub the image forming surface of the belt-like member strongly, so that a friction can be reduced.

Further, the image forming apparatus according to the present invention may include a back surface support member together with the second cleaning member. The back surface support member is arranged inside of the rotational path of the belt-like member at a position where the second cleaning member is arranged, and the back surface support member nips the belt-like member with the second cleaning member to support a back surface of the belt-like member from inner side.

Such configuration allows the second cleaning member to come in contact with the image forming surface of the belt-like member more assuredly, so that its cleaning effect can be brought out assuredly.

According to the present invention, a whole width direction of the belt-like member can be cleaned with a simple parts configuration without making an overall configuration of the apparatus be large.

Further, adopting the configuration according to the present invention enables cleaning of the belt-like member to be performed assuredly even if the overall size of the apparatus is made as small as possible.

This application is based on Japanese Patent Application Serial No. 2007-065470 filed in Japan Patent Office on Mar. 14, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a belt-like member having an endless belt-like image forming surface running through a predetermined rotational path for transferring a toner image formed on the image forming surface to another medium in accordance with the running of the endless belt-like image forming surface;

a first cleaning member for cleaning the image forming surface along a first cleaning width which is smaller than an entire width of the image forming surface after the toner image is transferred from the belt-like member to another medium, and a second cleaning member for cleaning side end portions out of the first cleaning width of the image forming surface.

2. The image forming apparatus according to claim 1, wherein:

the first cleaning member is a main cleaning member for cleaning an area including a central portion of an entire width of the image forming surface, and the second cleaning member is an auxiliary cleaning member arranged on an outer side of the main cleaning member in a width direction of the belt-like member.

3. The image forming apparatus according to claim 1, wherein the first cleaning member and second cleaning member are provided at positions different from one another in a rotational direction of a rotational path of the belt-like member.

4. The image forming apparatus according to claim 1, wherein the first cleaning width and a second cleaning width defined by the second cleaning member are overlapping with each other in a width direction of the belt-like member.

5. The image forming apparatus according to claim 1, wherein a contact area where the second cleaning member comes in contact with to clean the image forming surface includes a border line which is oblique with respect to the width direction of the belt-like member.

6. The image forming apparatus according to claim 5, wherein the border line is oblique toward downstream in the running direction of the belt-like member.

7. The image forming apparatus according to claim 1, wherein the second cleaning member is arranged at a side position or a lower position of the belt-like member on the rotational path, and a collecting portion for collecting remaining toners scraped off by the second cleaning member is provided at a further lower position of the second cleaning member.

8. The image forming apparatus according to claim 1, wherein the second cleaning member includes:

a felt-like member which comes in contact with the image forming surface of the belt-like member;

a base member for supporting the felt-like member; and an elastic member provided between the base member and the felt-like member to urge the felt-like member toward the image forming surface.

9. The image forming apparatus according to claim 1, further comprising:

a back surface support member arranged inside of the rotational path of the belt-like member at a position where the second cleaning member is arranged, the back surface support member nipping the belt-like member with the second cleaning member to support a back surface of the belt-like member from inner side.

10. The image forming apparatus according to claim 1, wherein the first cleaning member includes a roller which comes in rotational contact with the belt-like member in a width direction, and a width dimension of the roller corresponds to a cleaning width of the first cleaning member, and the cleaning width is so set as to be smaller than a width dimension of the belt-like member.

11. The image forming apparatus according to claim 10, wherein the second cleaning member extends toward a central portion from opposite end portions of the belt-like member, and amount of extension of the extended end portion is so set as to overlap with an end portion of the roller.

12. An image forming apparatus comprising:

a belt-like member having an endless belt-like image forming surface running through a predetermined rotational path for transferring a toner image formed on the image forming surface to another medium in accordance with the running of the endless belt-like image forming surface, the belt-like member having opposite side edges spaced from one another by a selected distance defining a width of the image forming surface;

a first cleaning member for cleaning the image forming surface along a first cleaning width which is smaller than the width of the image forming surface after the toner image is transferred from the belt-like member to another medium, and second cleaning members spaced from the first cleaning member along the predetermined rotational path and disposed for cleaning portions of the image forming surface adjacent the side edges of the belt-like member.

13. The image forming apparatus according to claim 12, wherein the second cleaning members are dimensioned to overlap with portions of the image forming surface cleaned by the first cleaning member.

14. The image forming apparatus according to claim 12, wherein a contact areas where the second cleaning members contact the image forming surface includes a border line that is oblique with respect to the width of the belt-like member.

* * * * *